US005462168A

United States Patent [19]

Oberhelman et al.

[11] Patent Number: 5,462,168

[45] Date of Patent: Oct. 31, 1995

[54] BEVERAGE CONTAINER COVER

[76] Inventors: David L. Oberhelman, 2 Queens La., Queensbury, N.Y. 12804; Lisa Herriman, 12 Third St., Glens Falls, N.Y. 12801

[21] Appl. No.: 249,759

[22] Filed: May 25, 1994

[51] Int. Cl.[6] ..... B65D 65/00; B65D 65/10

[52] U.S. Cl. ..... 206/457; 206/427; 220/903; 222/183; 222/105

[58] Field of Search ..... 206/457, 162, 206/139, 427; 220/903, 737, 740, 711, 412, 625; 222/183, 105

[56] References Cited

U.S. PATENT DOCUMENTS

| | | | |
|---|---|---|---|
| 2,954,901 | 10/1960 | Winstead | 222/183 |
| 3,119,544 | 1/1964 | Cope et al. | 222/183 |
| 3,160,326 | 12/1964 | Sturdevant et al. | 222/183 |
| 3,191,810 | 6/1965 | Johnston | 222/183 |
| 3,193,152 | 7/1965 | White | 222/183 |
| 3,246,825 | 4/1966 | Zastrow | 222/183 |
| 3,363,807 | 1/1968 | Powell | 222/183 |
| 4,336,883 | 6/1982 | Krug et al. | 206/545 |
| 4,784,314 | 11/1988 | Penick | 206/457 |
| 4,890,772 | 1/1990 | Heuberger et al. | 222/183 |
| 5,156,295 | 10/1992 | Gordon et al. | 222/183 |

*Primary Examiner*—Jimmy G. Foster
*Assistant Examiner*—Tara L. Laster
*Attorney, Agent, or Firm*—Heslin & Rothenberg

[57] ABSTRACT

A beverage container is disclosed herein. The apparatus of the present invention comprises a housing having an open bottom. The open bottom includes a front face, and the front face has an edge defining the open bottom. A handle is connected to the cover for lifting and lowering. An aperture is located on the front face for protrusion of a spout of a beverage container. The front face of the cover may have include a decorative panel, including or a decorative attachment. The housing may also have a coolant pack placed inside for thermal insulation. A method of placing the beverage container cover of the present invention over a wine container including a spout is also disclosed herein.

18 Claims, 6 Drawing Sheets

BEVERAGE CONTAINER COVER

BACKGROUND OF THE INVENTION

1. Technical Field

The present invention generally relates to boxes, and more particularly, to beverage container covers.

2. Background Information

In recent years, it has been found economical and convenient to use cardboard cartons to house various beverages. For example, in the liquor industry, wine is sold in various containers, including glass bottles, plastic bottles, and cardboard cartons. Cardboard cartons hold wine in various volumes. For instance, there are cardboard cartons of wine that hold two, three, five, and even more liters of wine. Generally, these cartons have spouts at the bottom for the release of the wine held therein. When a wine drinker desires some wine, the spout is activated to the open position while a glass is placed under the spout for filling. Once the drinker fills his glass to the desired amount, the spout is then closed.

A problem with these cardboard wine cartons, however, is that they are not pleasing to view. As a result, cardboard cartons of wine are often hidden from public view due to their unpleasant appearance. For instance, if wine is served in a cardboard container at a picnic, the carton is often placed underneath a picnic table. Moreover, if wine is served in a cardboard carton at a house party, the carton is often placed in a location separate from where the party is held, such as in the kitchen or in a closet.

Another problem with cardboard wine cartons is that they are not conducive to maintaining a chilled wine temperature. This is especially true when the cardboard container of wine is exposed to the sun.

Thus, a need exists for a removable beverage container cover which is pleasing to look at and which also maintains a cooled temperature for the beverage container held therein.

SUMMARY OF THE INVENTION

Briefly, the present invention satisfies the need for a beverage container cover to sit over and house unsightly beverage containers, such as cardboard cartons of wine. Moreover, the present invention satisfies the need for a beverage container cover which maintains a cool temperature. The aforementioned background problems are solved by the apparatus of this invention which provides an aesthetically pleasing cover which fits snugly over the top of a beverage container, such as a cardboard wine carton.

The beverage container cover comprises, in one embodiment, a housing having an open bottom. The beverage includes a front face, and the front face has an edge defining the open bottom. A handle is connected to the cover for lifting the cover. An aperture is located on the front face for the protrusion of a spout of a beverage container. The front face of the beverage container cover may comprise a decorative panel, and the decorative panel may include wall paper covering or a decorative attachment. The beverage container cover may include a removable bottom wall.

It is therefore an object of this invention to provide a beverage container cover which fits over a beverage container.

It is another object of this invention to provide a beverage container cover having a pleasant appearance.

It is yet another object of the present invention to provide a removable beverage container cover which can be reused.

It is still another object of this invention to provide a beverage container cover which maintains a cool temperature for the beverage held in the beverage container.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
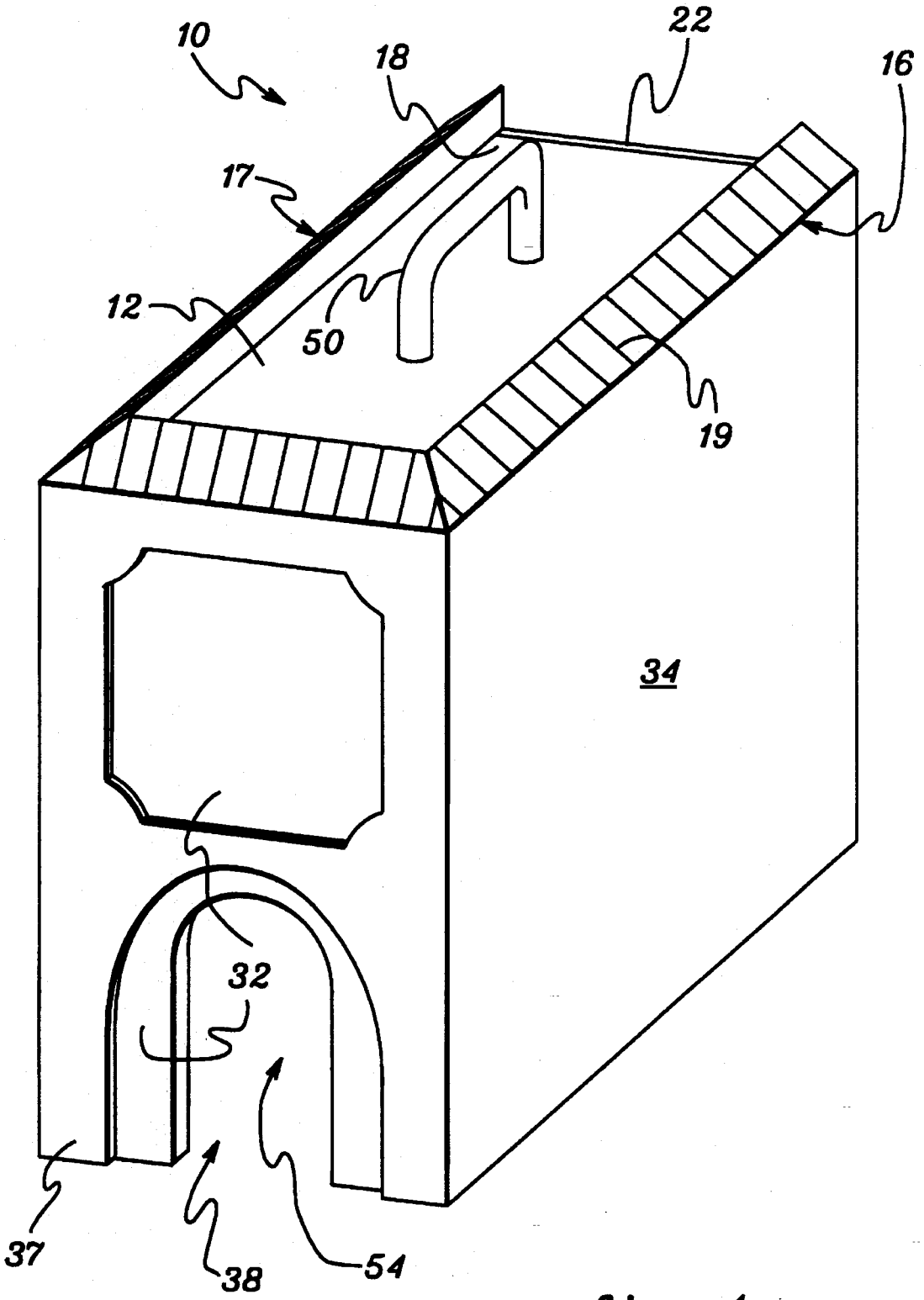
FIG. 1 is an orthographic view of the present invention.

Referring now to the drawings, and more particularly to FIG. 1, one embodiment of beverage container cover 10 is shown. In this embodiment, the present invention has five walls: a top wall 12, a back wall 22, a front wall 32, and two side walls 34 and 35. The joining of these walls forms a rectangularly shaped box. Cover 10 has an opening at the bottom to receive a cardboard carton of wine. An inner housing 54 is formed by the five walls. Each wall naturally has an inner face and an outer face. The inner faces of the walls define inner housing 54. The walls may be made of a variety of materials, but preferably wood. Furthermore, if wood is selected, paints, stains and varnishes may be used to enhance the appearance of cover 10.

Top wall 12 has a handle 50 attached thereto. As is shown in FIG. 1, handle 50 is attached in the center of top wall 12. The location of handle 50, however, may vary. In addition, handle 50 may be secured to top wall 12 by various different means. For instance, handle 50 may be attached to top wall 12 with an epoxy or glue. Alternatively, handle 50 may be fastened to top wall 12 with a screw mechanism. Handle 50 functions as a means to facilitate lifting of cover 10. Therefore, handle 50 aids one in covering and uncovering cardboard wine container 60 with cover 10 of the present invention. Moreover, in one embodiment, cover 10 may have a removable bottom wall 44 to not only cover wine container 60 but also to hold wine container 60 therein. The handle 50, therefore, will permit wine container cover 10 and wine container 60 held therein, to be picked up and moved.

Figure 3:
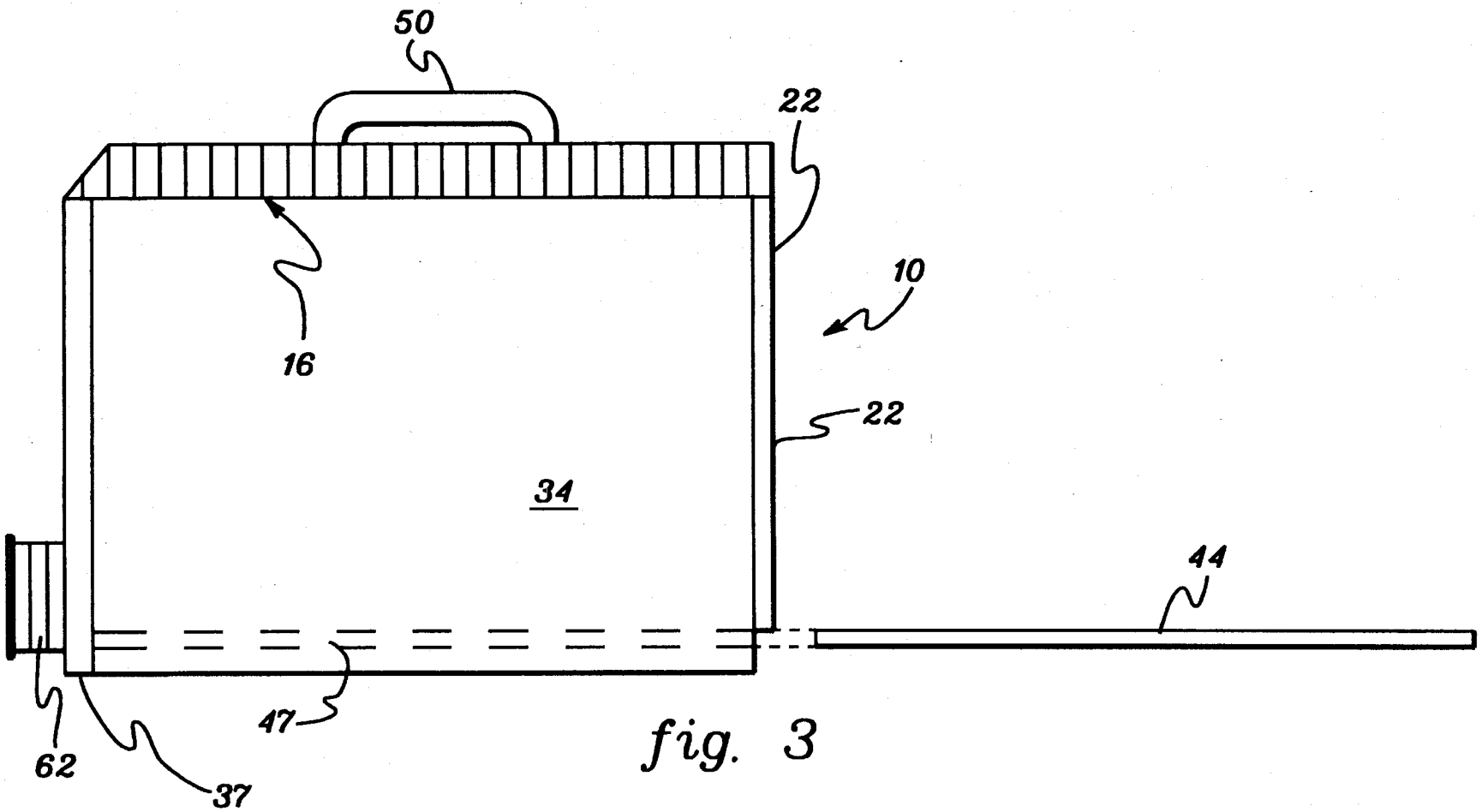
FIG. 3 is a side view of the present invention.
Figure 4:
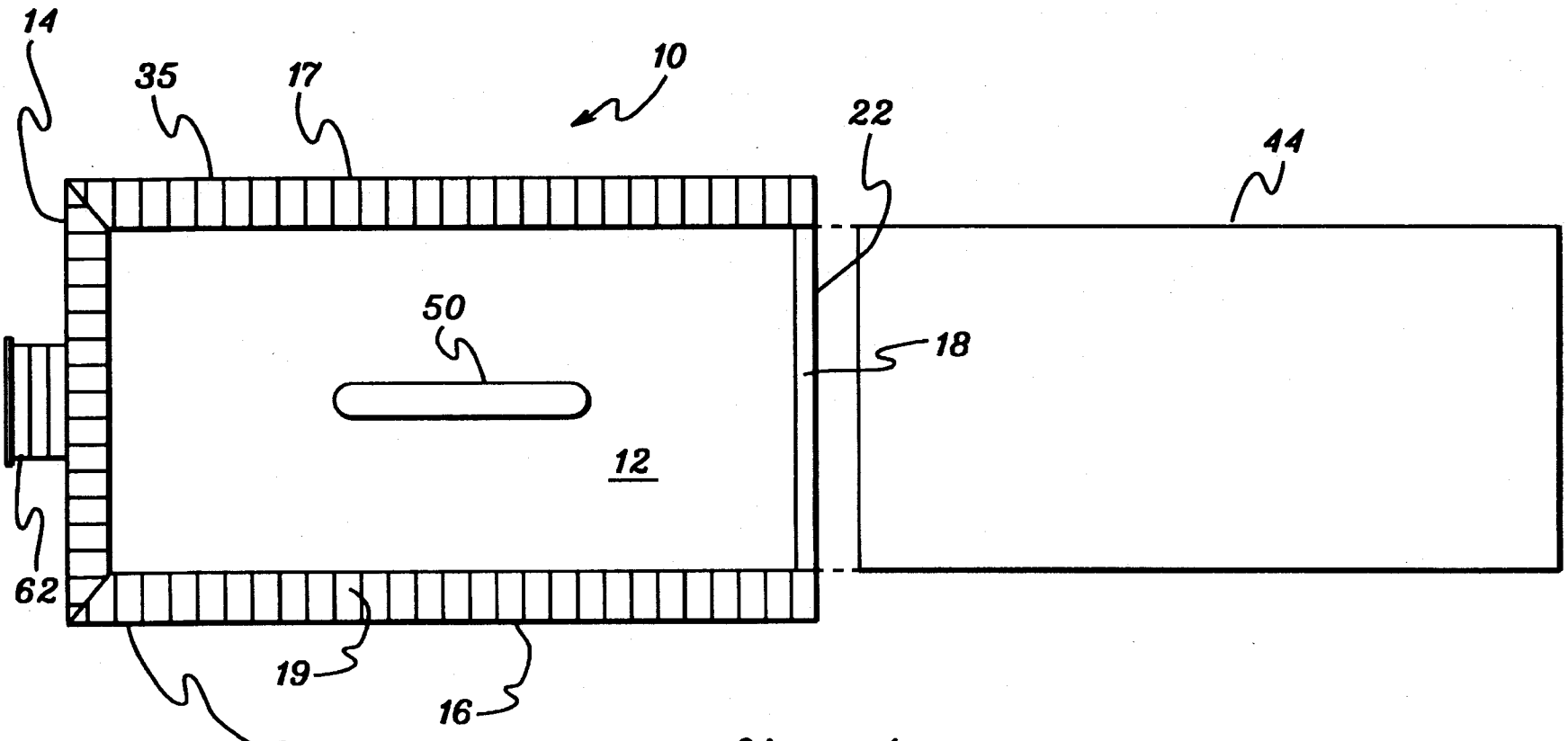
FIG. 4 is a top view of the present invention.
Figure 5:
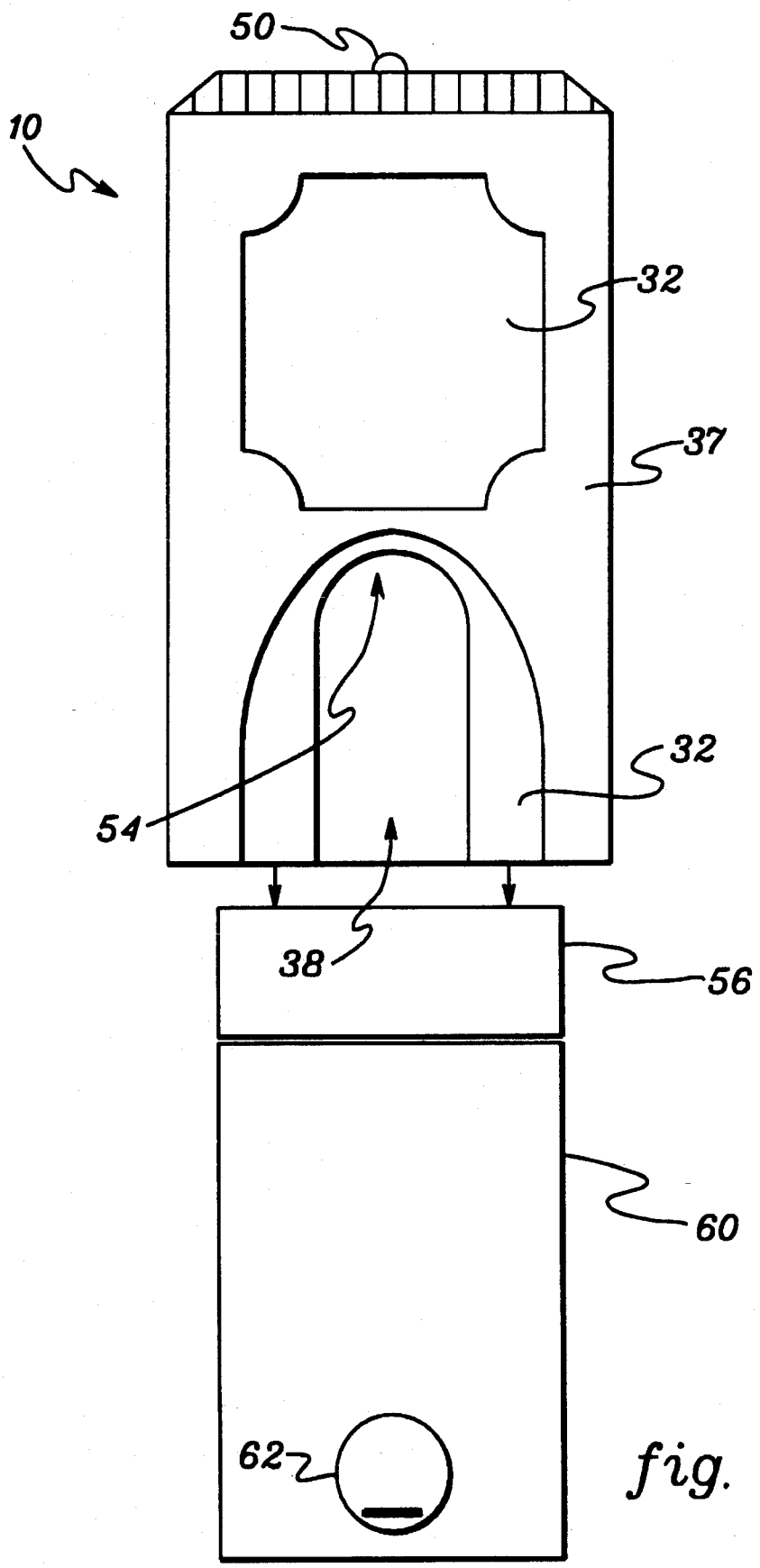
FIG. 5 is a front view of the present invention in combination with a beverage container.
Figure 6A:
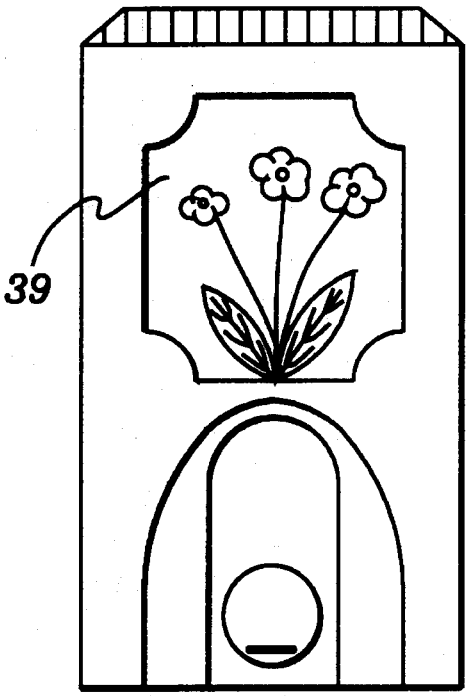
FIG. 6 depicts various embodiments of the present invention.
Figure 6B:
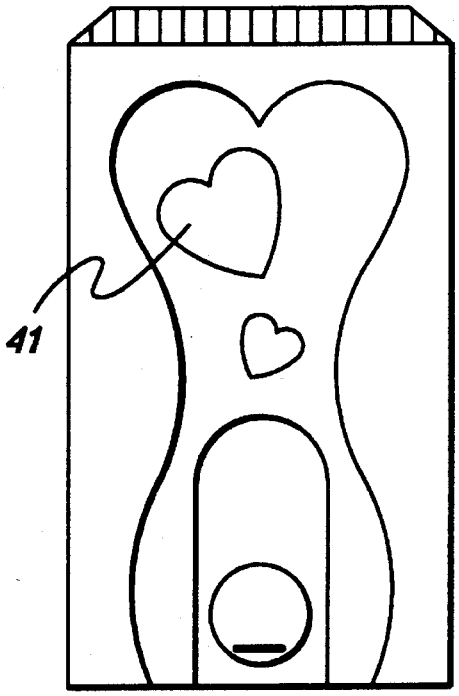
Figure 6C:
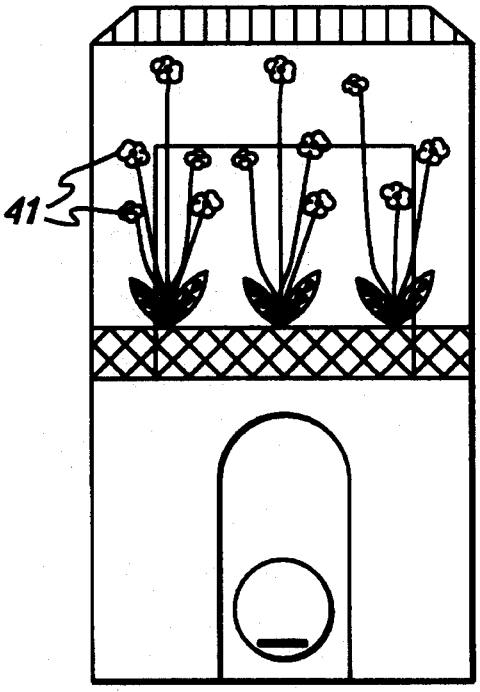
Figure 6D:
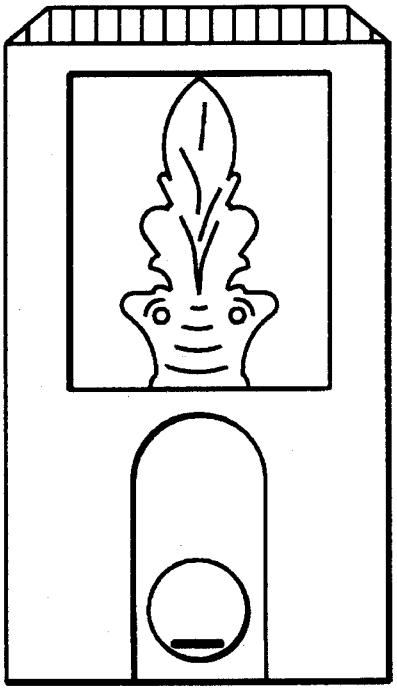

As is shown in FIGS. 1, 3, and 4, each wall has four edges. For instance, top wall 12 has a top wall front edge 14, a top wall back edge 18, and two top wall side edges 16 and 17. The remaining walls similarly have four edges. As shown in FIG. 1, an edge of a particular wall may be connected to an edge of a different wall, and the connection results in two walls to be situated at substantially a ninety-degree angle. Although each wall has four edges, each and every edge of a particular wall may not be connected to an edge of a different wall. For instance, while top wall 12 has all of its four edges connected to adjacent edges of other walls, front wall 32 only has three of its edges connected to adjacent edges of other walls. In fact, as shown in FIG. 1, top wall 12 is the only wall wherein each and every one of its edges are connected to adjacent edges. A molding 19 may sit along the outer perimeter of top wall 12.

The means for connecting adjacent edges of different walls together may comprise an epoxy. However, many other means for connection may be used. For instance, conventional nails and/or screws may be used to connect walls to one another.

Connected to top wall 12 is back wall 22. Back wall 22 extends downward, vertically from where top wall 12 connects to back wall 22. The connection of top wall 12 and back wall 22 substantially form a ninety degree angle. In addition, back wall 22 connects to sidewalls 34 and 35.

Connected to top wall 12 is front wall 32. Front wall 32 lies substantially parallel to back wall 22. Therefore, front wall 32 lies substantially in a vertical plane, and the connection of front wall 32 to top wall 12 substantially forms a ninety degree angle. Front wall 32 also has an aperture 38 therein. The function of aperture 38 is to provide an opening for a wine spout 62 to protrude therethrough. Spout 62 may also be known as a tap. Aperture 38 may be of various sizes and shapes. For instance, as depicted in FIG. 1, aperture 38 may be half-oval shaped. Although aperture 38 is located along the bottom edge of front wall 32, it will be understood that it could be located elsewhere, for example, in the middle.

The outer face of front wall 32 may include an outer panel 37, as depicted in FIG. 1. Outer panel 37 may have an aperture so that the outer face of front wall 32 is shown. Various aperture shapes may be selected. The combination of outer panel 37 and front wall 32 provide cover 10 with an aesthetically pleasing appearance. Front wall 32 may include wall paper covering 39. In addition, front wall 32 may include a decorative attachment 41.

Figure 2:
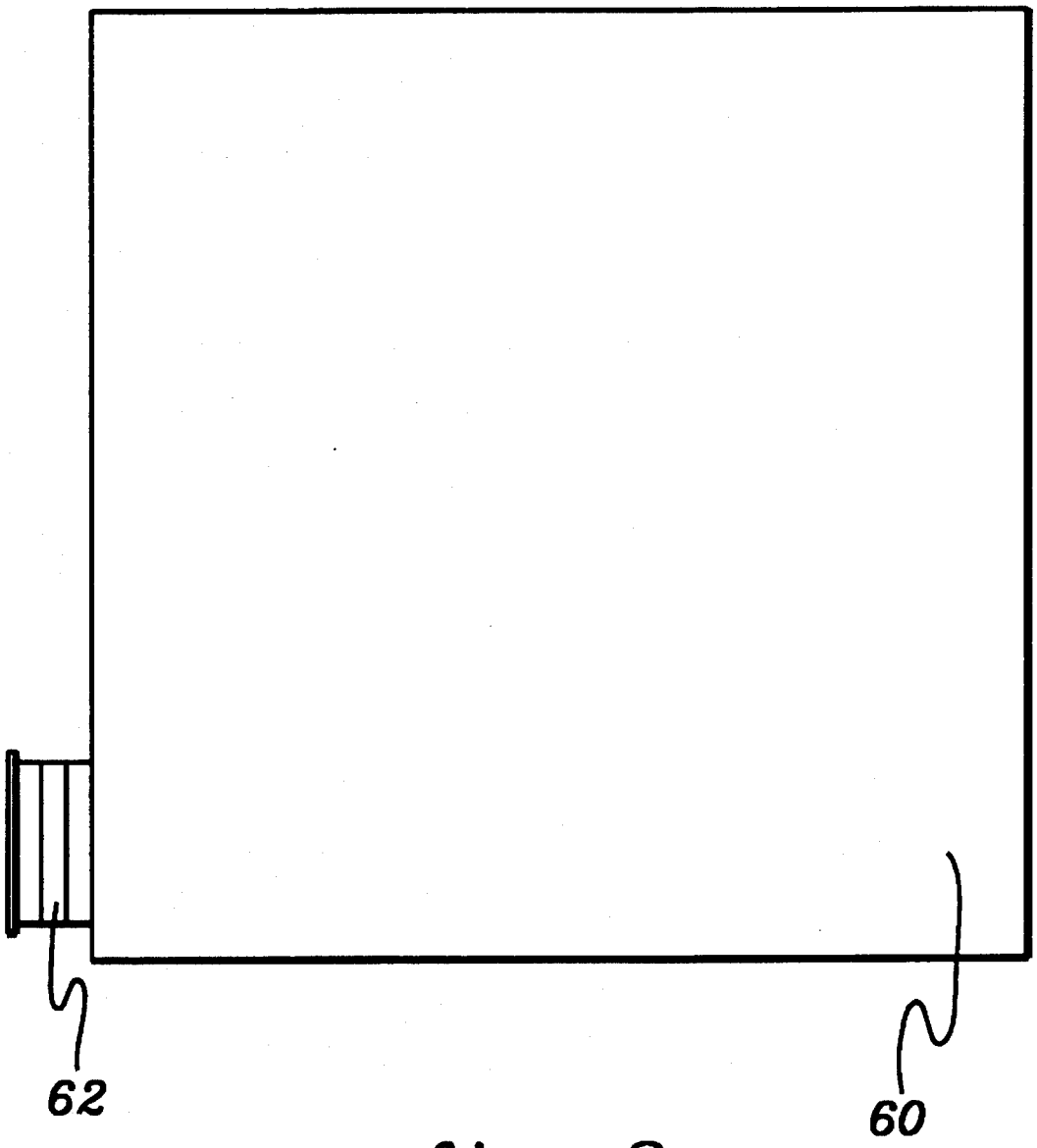
FIG. 2 is a side view of a cardboard container of wine.

Side walls 34 and 35, as shown in FIGS. 1, 2, and 3 in combination with front wall 32, top wall 12, and back wall 22 complete the rectangularly-shaped box structure of the present invention. Sidewalls 34 and 35 extend downward, vertically from edges 16 and 17, respectively.

Each wall naturally has an outer face and an inner face (not shown). The inner facing walls define an inner housing 54 which functions to receive a container of wine, such as cardboard wine carton 60. Therefore, inner housing 54 of the cover 10 acts to receive and cover cardboard carton of wine 60.

Cover 10 may also include a removable bottom wall 44. Bottom wall 44 maybe removably attached to cover 10. Once bottom wall 44 is attached, one can use handle 50 to carry wine container 60 to various locations. In one embodiment, bottom wall 44 is slidably attached to cover 10. A groove 47 in the inner face of sidewalls 34 and 35 may accommodate the slidable insertion of bottom wall 44.

Inner housing 54 of cover 10 may also include one or more coolant packs, such as coolant pack 56. Preferably, coolant pack 56 is placed along the inner face of top wall 12. By inserting wine container 60 with coolant pack 56, so that coolant pack sits on top of wine container 60, a cool atmosphere for the will may be provided.

The present invention allows wine container 60 to be placed at an openly viewable, easily accessible and desirable location. For instance, wine container 60 could be placed on a buffet table. Once a suitable location is selected, wine container cover 10 may be placed over cardboard carton 60. In order to place cover 10 over carton 60, aperture 38 of cover 10 is aligned so that spout 62 of wine carton 60 may protrude out through aperture 38.

If it is desired that wine container 60 be moved, bottom wall 44 may be removably attached. Therefore, bottom wall 44 may be slidably inserted into grove 47 in the inner face of sidewalls 34 and 35. The attachment of bottom wall 44 provides a secure housing for wine container 60, and if someone desires to re-locate the wine, that person can simply carry this wine container cover, with cardboard carton 60 held therein, using handle 50.

While several aspects of the present invention have been described and depicted herein, alternative aspects may be effected by those skilled in the art to accomplish the same objectives. For instance, it is not necessary for cover 10 to be of the rectangular-box shape, and if so desired, cover 10 may be oval shaped, such as like a barrel. Furthermore, various types of beverage containers may be used with the cover as described herein. Accordingly, it is intended by the appended claims to cover all such alternative aspects as fall within the true spirit and scope of the invention.

We claim:

1. A beverage container cover for covering a beverage container including a spout, said beverage container cover comprising:

a housing having an open bottom for receiving said beverage container, said housing including a front face having an edge defining said open bottom;

a handle connected to said cover for lifting said beverage container cover;

a decorative panel disposed on said front face; and an aperture located on said front face for protrusion of said spout.

2. The beverage container cover of claim 1, further comprising a removable bottom wall connectable to said cover, wherein when said removable bottom wall is attached, said housing of said beverage container cover is enclosed.

3. The beverage container cover of claim 1 wherein said beverage container is a wine container.

4. The beverage container cover of claim 3, wherein said wine container comprises a cardboard carton of wine.

5. The beverage container cover of claim 1, wherein said front face includes a wallpaper covering.

6. The beverage container of claim 1, wherein said front face includes a decorative attachment.

7. The beverage container cover of claim 1, wherein said beverage container cover is thermally insulating.

8. The beverage container cover of claim 7, wherein said beverage container cover further comprises a coolant pack.

9. A beverage container cover for covering a beverage container including a spout, said beverage container cover comprising:

a top wall having a handle attached thereto for lifting said beverage container cover;

a front wall having an aperture therein for protrusion of a spout, said front wall connected to said top wall and having a decorative panel;

a back wall connected to said top wall; and two side walls, each of said two side walls connected to said top wall, said back wall, and said front wall, wherein each of said front wall, said back wall, and said two side walls are configured in a substantially rectangular shape forming an open box with a receiving end, said receiving end for insertion of said beverage container into said beverage container cover.

10. The beverage container cover of claim 9 wherein said walls comprise wood.

11. The beverage container cover of claim 9 wherein said front wall includes a wall paper covering.

12. The beverage container cover of claim 10 wherein said front wall in includes a decorative attachment.

13. The beverage container of claim 9 wherein the handle is substantially centrally located on said top wall.

14. The beverage container cover of claim 9 wherein said beverage container is a wine container.

15. The beverage container cover of claim 14, wherein said wine container is a cardboard carton of wine.

16. The beverage container of claim 9, further comprising a removable bottom wall, said removable bottom wall slidably insertable into a slot, said slot located on an inner face of each of said two side walls.

17. A method of placing a beverage container cover over a wine container including a spout, comprising:

selecting a beverage container cover, comprising:

a housing having an open bottom for receiving said wine container, said housing including a front face having an edge defining said open bottom;

a handle connected to said cover for lifting said beverage container cover;

an aperture located on said front face for protrusion of said spout;

aligning said beverage container cover so that said aperture is vertically positioned above said spout; and placing said beverage container cover over said wine container.

18. The method of claim 17, wherein said beverage container cover further comprises a removable bottom wall, said method further comprising slidably attaching said removable bottom wall so that said wine container is secured within said beverage container cover.

* * * * *

UNITED STATES PATENT AND TRADEMARK OFFICE

CERTIFICATE OF CORRECTION

PATENT NO. : 5,462,168

DATED : October 31, 1995

INVENTOR(S) : Oberhelman et al.

It is certified that error appears in the above-indentified patent and that said Letters Patent is hereby corrected as shown below:

Column 5, line 1,
In claim 12, delete "10" and substitute therefor --9--.

Signed and Sealed this

Thirteenth Day of February, 1996

*Attest:*

Bruce Lehman

BRUCE LEHMAN

*Attesting Officer*

*Commissioner of Patents and Trademarks*